US012687312B2

(12) United States Patent
Klein et al.

(10) Patent No.: US 12,687,312 B2
(45) Date of Patent: Jul. 21, 2026

(54) AUTOMATED PROPERTY HUMIDITY CONTROL

(71) Applicant: Alarm.com Incorporated, Tysons, VA (US)

(72) Inventors: Jackson Alexander Klein, Herndon, VA (US); Robert Nathan Picardi, Greenville, SC (US)

(73) Assignee: Alarm.com Incorporated, Tysons, VA (US)

( * ) Notice: Subject to any disclaimer, the term of this patent is extended or adjusted under 35 U.S.C. 154(b) by 408 days.

(21) Appl. No.: 18/212,248

(22) Filed: Jun. 21, 2023

(65) Prior Publication Data

US 2024/0003564 A1 Jan. 4, 2024

Related U.S. Application Data

(60) Provisional application No. 63/356,509, filed on Jun. 29, 2022.

(51) Int. Cl.
*F24F 11/00* (2018.01)
*F24F 11/65* (2018.01)
(Continued)

(52) U.S. Cl.
CPC ..... *F24F 11/0008* (2013.01); *F24F 11/65* (2018.01); *F24F 2110/12* (2018.01); *F24F 2110/20* (2018.01)

(58) Field of Classification Search
CPC ..... G05B 13/04; G05B 15/00; F24F 11/30; F24F 11/63; F24F 11/65; F24F 11/0008;
(Continued)

(56) References Cited

U.S. PATENT DOCUMENTS 6,996,999 B2 * 2/2006 Wacker ..... G05D 22/02 236/44 C
8,958,921 B2 2/2015 Xu et al.
(Continued)

FOREIGN PATENT DOCUMENTS

EP 2042816 4/2009
EP 3537252 9/2019
(Continued)

OTHER PUBLICATIONS

Cao et al., "Smart sensing for HVAC control: Collaborative intelligence in optical and IR cameras," IEEE Transactions on Industrial Electronics, Dec. 2018, 65:(12) 9785-9794.
(Continued)

*Primary Examiner* — Ronald D Hartman, Jr.
(74) *Attorney, Agent, or Firm* — Fish & Richardson P.C.

(57) ABSTRACT

Methods, systems, and apparatus, including computer programs encoded on computer storage media, for adjusting an indoor humidity at a property. One of the methods includes determining an estimated outdoor temperature in an area around a property; determining, using the estimated outdoor temperature, a target indoor humidity for the property; accessing data about the property; predicting, using the data about the property, whether an indoor humidity of the property will likely change within a threshold time period; determining, using the target indoor humidity and the prediction whether the indoor humidity of the property will likely change within the threshold time period, whether to adjust the indoor humidity of the property; and in response to determining to adjust the indoor humidity of the property, controlling, using the target indoor humidity, humidity equipment at the property to cause an indoor humidity at the property to move toward the target indoor humidity.

20 Claims, 4 Drawing Sheets

(51) Int. Cl.
*F24F 110/12* (2018.01)
*F24F 110/20* (2018.01)

(58) Field of Classification Search
CPC F24F 2110/12; F24F 2110/20; H04L 12/2803
USPC ..... 700/276
See application file for complete search history.

(56) References Cited

U.S. PATENT DOCUMENTS

| | | | | |
|---|---|---|---|---|
| 9,164,519 | B2 * | 10/2015 | Holloway | F24F 11/30 |
| 9,696,055 | B1 | 7/2017 | Goodman et al. | |
| 9,874,360 | B2 * | 1/2018 | Hamada | F24F 1/0035 |
| 10,126,010 | B2 * | 11/2018 | Chen | F24F 11/65 |
| 10,281,896 | B1 | 5/2019 | Goodman et al. | |
| 10,847,009 | B1 | 11/2020 | Sulucz et al. | |
| 10,859,283 | B1 | 12/2020 | Goodman et al. | |
| 11,193,689 | B2 * | 12/2021 | Turney | F24F 11/80 |
| 11,359,969 | B2 | 6/2022 | Shayne et al. | |
| 11,460,205 | B2 | 10/2022 | Goodman et al. | |
| 11,473,806 | B2 * | 10/2022 | Kulandaisamy | F24F 11/86 |
| 2003/0050737 | A1 | 3/2003 | Osann, Jr. | |
| 2005/0040247 | A1 | 2/2005 | Pouchak | |
| 2005/0040249 | A1 | 2/2005 | Wacker et al. | |
| 2008/0056568 | A1 | 3/2008 | Porikli et al. | |
| 2009/0001181 | A1 | 1/2009 | Siddaramanna et al. | |
| 2009/0108082 | A1 | 4/2009 | Goldmann et al. | |
| 2010/0070089 | A1 | 3/2010 | Harrod et al. | |
| 2010/0324962 | A1 | 12/2010 | Nesler et al. | |
| 2011/0178977 | A1 | 7/2011 | Drees | |
| 2012/0042672 | A1 * | 2/2012 | Fujihara | F24F 3/14 62/157 |
| 2012/0143356 | A1 | 6/2012 | Berg-Sonne et al. | |
| 2012/0219211 | A1 | 8/2012 | Ding et al. | |
| 2013/0024799 | A1 | 1/2013 | Fadell et al. | |
| 2013/0030600 | A1 | 1/2013 | Shetty et al. | |
| 2013/0030732 | A1 | 1/2013 | Shetty et al. | |
| 2013/0103207 | A1 | 4/2013 | Ruff et al. | |
| 2013/0314536 | A1 | 11/2013 | Frank et al. | |
| 2014/0085093 | A1 | 3/2014 | Mittleman et al. | |
| 2014/0093133 | A1 | 4/2014 | Frank et al. | |
| 2014/0112537 | A1 | 4/2014 | Frank et al. | |
| 2014/0148706 | A1 | 5/2014 | Van Treeck et al. | |
| 2014/0172400 | A1 | 6/2014 | Majewski et al. | |
| 2014/0207281 | A1 | 7/2014 | Angle et al. | |
| 2014/0277757 | A1 | 9/2014 | Wang et al. | |
| 2014/0277765 | A1 | 9/2014 | Karimi et al. | |
| 2014/0367079 | A1 | 12/2014 | DiFulgentiz, III | |
| 2015/0161779 | A1 | 6/2015 | Hamann et al. | |
| 2015/0189195 | A1 | 7/2015 | Hamann et al. | |
| 2015/0248754 | A1 | 9/2015 | Graner et al. | |
| 2016/0116178 | A1 | 4/2016 | Vega | |
| 2016/0320085 | A1 | 11/2016 | Silawan et al. | |
| 2016/0341603 | A1 | 11/2016 | Kusukame et al. | |
| 2016/0363340 | A1 | 12/2016 | Shikii et al. | |
| 2017/0020432 | A1 | 1/2017 | Kusukame et al. | |
| 2017/0088098 | A1 | 3/2017 | Frank et al. | |
| 2017/0328997 | A1 | 11/2017 | Silverstein et al. | |
| 2019/0026908 | A1 | 1/2019 | Finn et al. | |
| 2019/0032950 | A1 | 1/2019 | Nakamura et al. | |
| 2019/0200872 | A1 | 7/2019 | Matsuoka et al. | |
| 2019/0205655 | A1 | 7/2019 | Matsuoka et al. | |
| 2019/0212760 | A1 | 7/2019 | Tiwari et al. | |
| 2019/0309968 | A1 | 10/2019 | Nalajala et al. | |
| 2019/0309975 | A1 * | 10/2019 | Salem | F24F 11/64 |
| 2019/0310137 | A1 | 10/2019 | Pop | |
| 2019/0353369 | A1 * | 11/2019 | George | G05B 13/024 |
| 2019/0387185 | A1 | 12/2019 | Hicks | |
| 2020/0090477 | A1 | 3/2020 | Monge Nunez et al. | |
| 2021/0088241 | A1 | 3/2021 | Goodman et al. | |
| 2021/0102861 | A1 * | 4/2021 | Ellis | G01M 3/16 |
| 2021/0239534 | A1 | 8/2021 | Shayne et al. | |
| 2021/0247084 | A1 | 8/2021 | Vanderplaat et al. | |
| 2022/0307907 | A1 | 9/2022 | Shayne et al. | |
| 2023/0014112 | A1 | 1/2023 | Goodman et al. | |

FOREIGN PATENT DOCUMENTS

| | | |
|---|---|---|
| GB | 2177500 | 1/1987 |
| WO | WO 2019/046580 | 3/2019 |

OTHER PUBLICATIONS

Du et al., "A Novel Human Activity Recognition and Prediction in Smart Home Based on Interaction," Sensors, 2019, 19(20): 4474 (16 pages).

PCT International Search Report and Written Opinion in International Appln. No. PCT/US2023/068762, mailed on Oct. 10, 2023, 10 pages.

Extended European Search Report in European Appln. No 23832452.9, mailed on Oct. 2, 2025, 14 pages.

* cited by examiner

AUTOMATED PROPERTY HUMIDITY CONTROL

CROSS-REFERENCE TO RELATED APPLICATION

This application claims the benefit of U.S. Provisional Application No. 63/356,509, filed Jun. 29, 2022, the contents of which are incorporated by reference herein.

BACKGROUND

Central heating, ventilation, and air conditioning (HVAC) can maintain a comfortable climate within a building throughout the year. For instance, air conditioning can maintain air temperature at a set temperature and humidity during the summer. HVAC can be supplemented with a standalone humidifier to add moisture to dry air during the winter.

SUMMARY

In general, one innovative aspect of the subject matter described in this specification can be embodied in methods that include the actions of determining an estimated outdoor temperature in an area around a property; determining, using the estimated outdoor temperature, a target indoor humidity for the property; accessing data about the property, at least some of the data received from one or more sensors at the property; predicting, using the data about the property, whether an indoor humidity of the property will likely change within a threshold time period; determining, using the target indoor humidity and the prediction whether the indoor humidity of the property will likely change within the threshold time period, whether to adjust the indoor humidity of the property; and in response to determining to adjust the indoor humidity of the property, controlling, using the target indoor humidity, humidity equipment at the property to cause an indoor humidity at the property to move toward the target indoor humidity.

In general, one innovative aspect of the subject matter described in this specification can be embodied in methods that include the actions of determining an estimated outdoor temperature in an area around a property; determining, using the estimated outdoor temperature, a target indoor humidity for the property; accessing data about the property, at least some of the data received from one or more sensors at the property; predicting, using the data about the property, whether an indoor humidity of the property will likely change within a threshold time period; determining, using the target indoor humidity and the prediction whether the indoor humidity of the property will likely change within the threshold time period, whether to adjust the indoor humidity of the property; and in response to determining not to adjust the indoor humidity of the property, determining to skip controlling humidity equipment at the property to cause an indoor humidity at the property to move toward the target indoor humidity.

Other embodiments of this aspect include corresponding computer systems, apparatus, computer program products, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. In some implementations, the method can include, in response to determining to adjust the indoor humidity of the property, controlling, using the target indoor humidity, humidity equipment at the property to cause an indoor humidity at the property to move toward the target indoor humidity. The method can include, in response to determining not to adjust the indoor humidity of the property, determining to skip controlling the humidity equipment.

In some implementations, determining whether to adjust the indoor humidity of the property can use i) the target indoor humidity, ii) the prediction whether the indoor humidity of the property will likely change within the threshold time period, and iii) a humidity threshold. The humidity threshold can be one or more of a maximum humidity level or a minimum humidity level.

In some implementations, determining whether to adjust the indoor humidity of the property can use i) the target indoor humidity, ii) the prediction whether the indoor humidity of the property will likely change within the threshold time period, and iii) a humidity set point setting for a heating, ventilation, and air conditioning system.

In some implementations, accessing data about the property can include accessing sensor data that indicates one or more current activities at the property. Predicting whether the indoor humidity of the property will likely change within the threshold time period can use the sensor data that indicates the one or more current activities at the property.

In some implementations, controlling the humidity equipment can include controlling one or more of a thermostat, a humidifier, a dehumidifier, or an external air vent.

In some implementations, the method can include selecting, from multiple different types of humidity equipment, the humidity equipment using one or more of the estimated outdoor temperature, or an estimated outdoor humidity.

In some implementations, controlling, using the target indoor humidity, humidity equipment at the property to cause an indoor humidity at the property to move toward the target indoor humidity can include adjusting a setting on a thermostat to cause the indoor humidity at the property to move toward the target indoor humidity. Adjusting the setting on the thermostat to cause the indoor humidity at the property to move toward the target indoor humidity can be performed without receiving user input.

In some implementations, the method can include determining one or more attributes of a heating cycle or a cooling cycle at the property; and selecting, using the one or more attributes, a time period during which to control the humidity equipment. Controlling the humidity equipment can include sending one or more instructions to the humidity equipment to cause the humidity equipment to adjust the indoor humidity during the time period. The one or more attributes of the heating cycle or the cooling cycle can include one or more of a start time for the cycle, a duration for the cycle, or a set point for the cycle.

In some implementations, the method can include determining, from multiple different types of humidity equipment, humidity equipment available to adjust the indoor humidity at the property. Determining whether to adjust the indoor humidity can use data identifying the humidity equipment available to adjust the indoor humidity at the property. Determining the humidity equipment available to adjust the indoor humidity at the property can use one or more of the estimated outdoor temperature, or an estimated outdoor humidity.

In some implementations, the method can include determining whether a change between the estimated outdoor temperature and a prior estimated outdoor temperature satisfies a threshold. Determining whether to adjust the indoor humidity of the property can use a result of determining that the change between the estimated outdoor temperature and the prior estimated temperature satisfies the threshold.

The subject matter described in this specification can be implemented in various embodiments and may result in one or more of the following advantages. In some implementations, automatically adjusting the humidity can improve the energy efficiency, performance, a lifetime of heating, ventilation, and air conditioning (HVAC) systems, or a combination of these. In some implementations, dehumidifying a property during the winter using the external air vent can reduce power consumption because there is no need to use a dehumidifier or the AC system separately for dehumidification. In some implementations, the system can automatically adjust indoor humidity setpoints during winter to satisfy recommended healthy levels based on the outdoor temperature without requiring additional hardware. In some implementations, multiple sensors throughout the property can be used to maintain consistent humidity levels. In some implementations, automatically adjusting the humidity can prevent fogging and dew, e.g., on glass windows or doors at the property, which if left unchecked, can lead to mold, mildew, and structural damage. In some implementations, centralizing control in a smart thermostat can reduce the required computing power, resources, hardware, or a combination of these. In some implementations, use of water meter data, video analytics, or both, e.g., by a machine learning model, can reduce the energy consumption of the HVAC equipment by predicting the humidity and temperature fluctuation of the home to avoid running when not needed in the near future.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
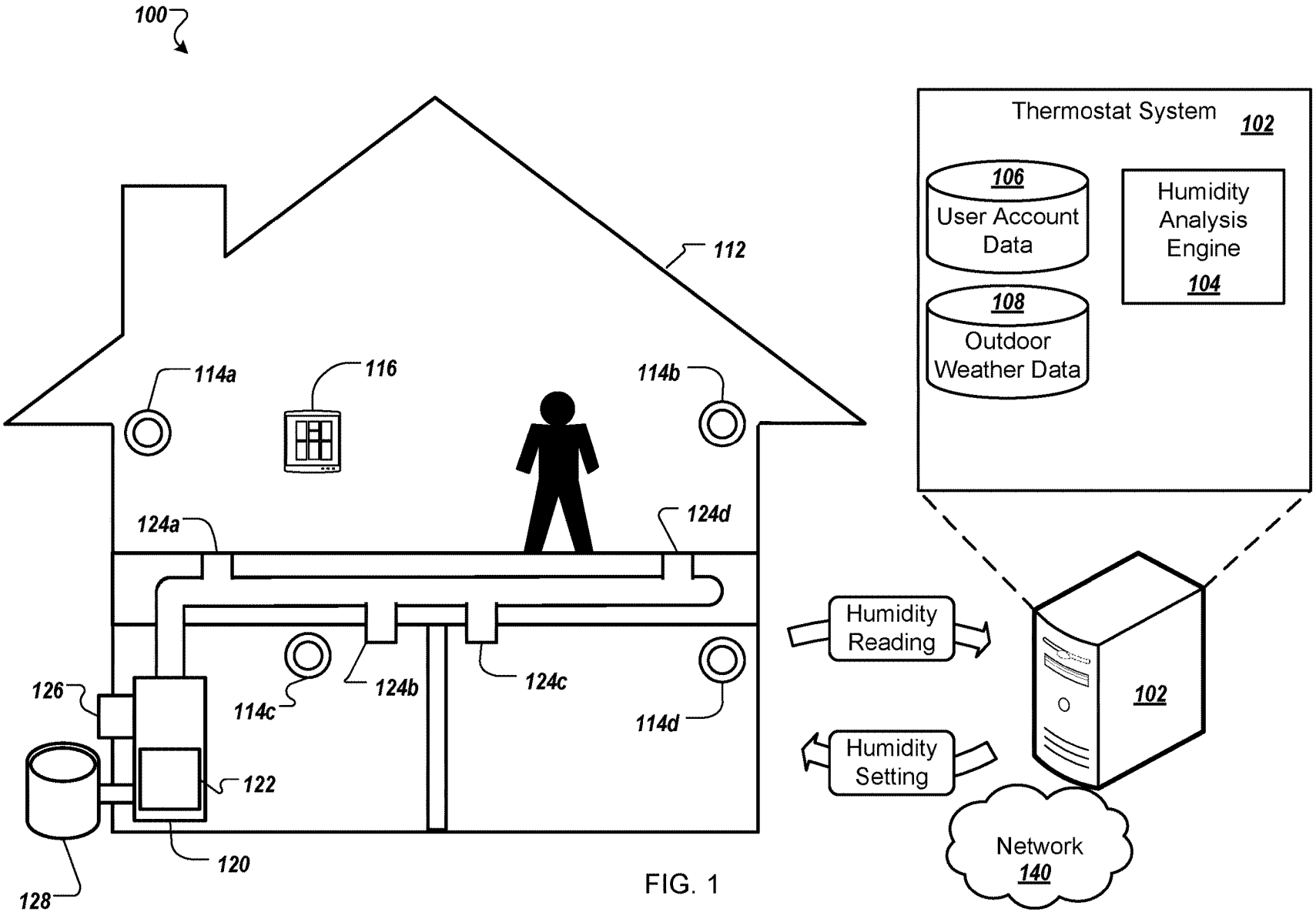
FIG. 1 depicts an example environment for automated humidity control.

Humidity levels within a property, e.g., a home or business, are an important consideration not only for structural concerns of the home, furniture, and flooring but also for human health and comfort. An indoor humidity range of 40-60% is optimal for human health, as this range promotes rapid deterioration of typical airborne viruses and pollutants, including coronaviruses. Property owners may switch from dehumidifying their property in summer months to humidifying their property in the winter months because heating air typically drops the relative humidity.

While a humidity range of 40-60% is recommended for health and comfort for most of the year, as the temperature outdoors decreases in the winter, the indoor humidity levels should adjust to lower levels as concerns to home structural integrity and mold growth become more important. If the air is too humid in the winter, the contrast between the cool, dry outdoor air and the warm, humid indoor air can cause dew generation within the home structure and fogging of windows. This can lead to mold and mildew growth, or degradation to the building structure. At the same time, humidity levels should remain high enough to avoid negatively impacting human health and comfort. Without automatic adjustments to a humidification setpoint, property owners may humidify to percentages higher than recommended levels throughout much of the winter.

Smart thermostats can accommodate running a number of heating, ventilation, and air conditioning (HVAC) accessories on dedicated configurable terminals including: humidifiers, dehumidifiers, and external air vents. A humidifier, dehumidifier, and external air vent can be different types of humidity equipment. Using these accessory terminals enables a user, e.g., a homeowner, to control their entire home HVAC equipment from a single thermostat.

With an onboard temperature and humidity sensor, the smart thermostats can control both temperature and humidity from the same unit. The user can then use a smart thermostat application to adjust the humidity operating mode and humidity setpoint as desired. In some examples, this setup does not require separate control boards for each HVAC accessory in addition to the thermostat for temperature control. As a result, the homeowner does not need to manually adjust the humidity setpoint on their humidification controller separately from their thermostat.

In addition to the smart thermostat, remote temperature sensors can be placed anywhere in the home and smart system will allow for the temperature reading from each sensor to be averaged so the thermostat runs off the average temperature of the entire home rather than only the temperature reading in the room where the thermostat resides. In some examples, remote sensors may measure and report humidity along with or instead of temperature.

In some implementations, a smart system, e.g., a smart thermostat system, can provide a whole property, automated, smart humidity control by combining a smart thermostat and real time understanding of outdoor weather collected on the cloud. The smart humidity control can automatically adjust humidity without any input from the user as the seasons change. For example, the smart system can begin a smart humidity control plan when the outdoor temperature falls below a preset temperature (e.g., 40 degrees Fahrenheit (F)).

The smart system can control the humidity with only a single smart thermostat controller device. The system can collect weather information in order to understand and provide insight on the outdoor temperature and conditions at the home location. The weather information can be localized to the zip code where each property is located, e.g., based on user account data, and the insight can be provided to both the user and the controller.

The smart thermostat controller can be adapted to communicate with the HVAC equipment the homeowner has connected to their thermostat in order to control over indoor humidity. In some examples, existing compatible equipment, such as remote temperature/humidity sensors, may be utilized. In some implementations, the smart system provides an improvement over traditional automated humidity control which requires a dedicated humidity controller that's separate from the thermostat, and outdoor temperature sensing equipment tied into that humidity controller. Indoor humidity levels can be automatically adjusted to match the optimal level based on the current outdoor temperature during the winter with only a smart thermostat and an attached humidifier.

FIG. 1 depicts an example environment 100 for automated humidity control. The environment 100 may include a thermostat system 102 for controlling the humidity of property 112. In some embodiments, a property type of property 112 can include a residential or commercial property. For example, the property type can include a primary residence, vacation home, rental property, or business. In some embodiments, information about the property 112 can be can be part of the user account data 106 described further bellow. For example, the property type, size, and number and location of sensors 114*a-d* can be stored in the user account data 106. The size of the property can include square footage or volume, e.g., cubic feet, yards, or meters.

The property 112 can include sensors 114*a-d* located through the property. For example, sensors 114*a* and 114*b* can be located in opposite corners of a great room. In some examples, sensors 114*c* and 114*d* can be placed in separate rooms, e.g., bedroom, kitchen, or hallway. In some embodiments, at least one sensor can be placed in each room of property 112. In some examples, sensors 114*a-d* can be attached to at least one return air duct to sense the humidity of the return air. In some embodiments, sensors 114*a-d* can include remote temperature sensors which can detect temperature. In some embodiments, sensors 114*a-d* can include remote humidity sensors which can detect humidity. In some embodiments, sensors 114*a-d* can include sensors which can detect both temperature and humidity.

The property 112 can include HVAC system 120. In some embodiments, the HVAC system 120 can include all of the ductwork and vents inside of the property 112. The HVAC system 120 can include return vent 122, vents 124*a-d*, and air intake 126. The return vent 122 can pull in air from the house. In some embodiments, HVAC system 120 can include multiple return vents which can collect air from separate portions of the property 112. The vents 124*a-d* can distribute air throughout the property 112. For example, vents 124*a* and 124*d* can be located in opposite corners of a great room. In some examples, vents 124*b* and 124*c* can be placed in separate rooms, e.g., bedroom, kitchen, or hallway. In some embodiments, at least one vent can be placed in each room of the property 112. In some embodiments, HVAC system 120 can include outdoor unit 128. For example, outdoor unit 128 can include a heat pump for efficiently cooling the property 112. The outdoor unit 128 can include a condenser or evaporator unit.

In some embodiments, property 112 can include humidity equipment, e.g. humidifiers or dehumidifiers. In some embodiments, the humidity equipment can be part of HVAC system 120. For example, a heater can heat water, e.g., to create steam, to increase the humidity of the air expelled from vents 124*a-d*. In some examples, the HVAC system 120 can include a dehumidifier to lower the humidity of expelled air. In some embodiments, the humidity equipment can be separate from HVAC system 120. For example, separate humidity equipment can be controlled by thermostat system 102, e.g., wirelessly through network 140.

The property 112 can include thermostat 116. The thermostat 116 can be located in a central location of property 112. In some embodiments, the thermostat 116 can be fixed in place. For example, the thermostat 116 can be located on a wall in a central location of property 112. In some embodiments, the thermostat 116 can be included in a standalone device. For example, the thermostat 116 can be a remote control or accessed through an application on a device, e.g., tablet, laptop, phone, or other mobile device. In some examples, the thermostat 116 can be custom hardware, e.g., a device with a screen, keypad, and computing hardware.

In some embodiments, the thermostat 116 can provide a user options to control both the humidity and the temperature of property 112. In some embodiments, the thermostat 116 can control the HVAC system 120 and humidity equipment, and communicate with sensors 114*a-d*, e.g. through network 140.

The thermostat system 102 can communicate with HVAC system 120, sensors 114*a-d*, and humidity equipment to adjust the temperature and humidity. In some embodiments, the thermostat system 102 can be included in the thermostat 116. In some embodiments, thermostat system 102 can include the thermostat 116. In some embodiments, the thermostat system 102 can be located on a server and communicate with the thermostat 116, e.g. through network 140. In some embodiments, the thermostat system 102 can receive temperature and humidity settings from a user, e.g., property owner, HVAC technician, or administrator.

The thermostat system 102 can include the user account data 106. The user account data 106 can include different settings for when the property is occupied and when the property is empty. For example, humidity levels may be set to balance comfort and safety when the property is occupied, e.g., homeowner is home from work, a business is open, or the property is rented. The user account data 106 can include a number of residents. The user account data 106 can include different settings for when the property is occupied and when the property is empty. For example, humidity levels may be set to balance comfort and safety when the property is occupied, e.g., homeowner is home from work, a business is open, the property is rented. In some examples, the humidity levels may be set to preserve the property, e.g., prevent mold or mildew, when the property is empty.

The thermostat system 102 can include the outdoor weather data 108. In some embodiments, the outdoor weather data 108 can be obtained without an outdoor thermometer or temperature sensor at property 112. For example, the thermostat system 102 can retrieve the outdoor weather data 108 based on an address or zip code of the property 112 through network 140. In some embodiments, the outdoor weather data 108 can include the current weather, e.g., temperature, humidity, raining, or sunny, and weather forecasts, e.g., daily forecast or hourly forecast.

The thermostat system 102 can include the humidity analysis engine 104. In some embodiments, the humidity analysis engine 104 can determine a target indoor humidity level. The thermostat system 102 can then adjust the humidity for the property 112 automatically without user input. The humidity analysis engine 104 can determine the target indoor humidity levels using seasonal humidity rules. The seasonal humidity rules can include an optimal humidity level based on the current outdoor temperature. In some embodiments, the humidity analysis engine 104 can receive current outdoor temperature on a pre-determined interval, e.g., from existing weather APIs. The humidity analysis engine 104 can use account information stored in user account data 106 to receive outdoor weather data for the property 112. The thermostat system 102 can adjust the humidity setpoint on the thermostat 116 based on the current outdoor temperature, and can then run a home humidifier as needed to satisfy the recommended indoor humidity level.

In some embodiments, the humidity analysis engine 104 can determine the optimal indoor humidity range according to Equation (1), below.

$$Rh=0.5(OT)+25;\ \text{for OT between } -20\text{ F and } 40\text{ F}, \quad (1)$$

In Equation (1), Rh is the indoor relative humidity setpoint, and OT is the outdoor temperature in degrees Fahrenheit (F). In some examples, Equation (1) can be adapted for degrees in Celsius. For example, the humidity analysis engine 104 can set the humidity according to table 1 below.

TABLE 1

| Outdoor Temperature (F.) | Recommended Indoor Humidity (RH %) |
|---|---|
| 40 | 45 |
| 30 | 40 |
| 20 | 35 |
| 10 | 30 |
| 0 | 25 |
| −10 | 20 |
| −20 | 15 |

In some embodiments, the humidity analysis engine 104 can set the humidity according to Equation (1) during the winter months, and can set the humidity according to user preferences, e.g., up to a predetermined maximum, during the other months. In some embodiments, the humidity analysis engine 104 can set the humidity according to Equation (1) in response to determining the outdoor temperature satisfies a threshold value. For example, if the outdoor temperature is below −20 F the humidity setpoint can be kept at 15 to maintain comfort. If the outdoor temperature rises above 40 F the existing user preset humidity desired range can be used instead. In some embodiments, the humidity analysis engine 104 can set the humidity according to Equation (1) whenever the heater of HVAC system 120 is in use. The thermostat system 102 can adjust the humidity levels in the property to the optimal humidity levels without any extra equipment or effort by the property owner. The optimal humidity levels can prevent structural damage to the home due to excessive humidification.

In some embodiments, the humidity analysis engine 104 can determine a target indoor humidity level based on a weather forecast and a schedule of the user. The humidity analysis engine 104 can obtain a prediction, e.g., hourly or daily, of the outside humidity. In some embodiments, the humidity analysis engine 104 can determine a delay, e.g., period of time, for the thermostat system 102 to adjust the indoor humidity to the target level. The delay can be predicted based on the predicted and current outdoor temperature, dew point, humidity, or a combination of these, throughout day. In some embodiments, the thermostat system 102 can track an indoor cooling or heating cycle, and humidifying or dehumidifying cycle, and store the indoor cycles with corresponding outdoor temperature and humidity.

In some embodiments, the thermostat system 102 can use machine learning to predict the indoor cycles. For example, the thermostat system 102 can predict how long the cycle will take, and what time of day the cycle will start and end. The humidity analysis engine 104 can optimize humidity events, e.g., running a humidifier or dehumidifier, using the predicted indoor cycles and corresponding outdoor temperature and humidity. For example, the humidity analysis engine 104 can schedule the humidity events to minimize power consumption.

In some embodiments, the humidity analysis engine 104 can use current user data and user schedules to predict humidity levels. The current user data can include a current occupancy and current activities of the occupants. The current activities can include actives which increase the humidity levels in the property, e.g., showering, cooking, or working out. In some embodiments, the thermostat system 102 can obtain the current occupancy and current activities using monitoring devices, e.g., proximity sensors, motion detectors, video cameras, smart locks. In some examples, the thermostat system 102 can identify a number of users and activities using video analytics. For example, the thermostat system 102 can determine that a person is in a kitchen, and that the person is cooking.

In some embodiments, the thermostat system 102 can predict humidity levels based on the current water usage, e.g., using water meters or other sensors. In some embodiments, the thermostat system 102 can monitor hot water usage, e.g., from a hot water heater. In some embodiments, a smart water meter can monitor the main line for the entire property. For example, the thermostat system 102 can identify certain activities throughout the day using the current water usage, and predict the effect on the humidity level. In some examples, the thermostat system 102 can determine that a shower is in use because showers have very predictable flow rates and fairly predictable durations. In some examples, a smart water meter can monitor the main line and outdoor usage separately, e.g., for hoses and irrigation. The outdoor water can come from a different water main, e.g., grey water. In some embodiments, the thermostat system 102 can communicate with smart irrigation systems through network 140 to obtain water usage data, e.g., time of usage and volume.

In some embodiments, the humidity analysis engine 104 can access a user schedule stored in user account data 106. The user account data 106 can include a user schedule of activities conducted in the property and the effect on humidity. For example, the user schedule may include a time when residents shower, cook or work out. Any changes in humidity caused by user activities can be recorded in the user account data 106. In some embodiments, the user schedule can be determined using historical water usage data. In some embodiments, the user account data 106 can include scheduled HVAC operations. For example, the scheduled HVAC operations can include heating up the property in the morning. In some embodiments, the user account data 106 can include estimated occupancy during different times of day, e.g., business hours, closed, at work, at home. In some embodiments, the humidity analysis engine 104 can determine a density of occupants, e.g., occupants per square foot, occupants per cubic foot or yard.

In some embodiments, the thermostat system 102 can delay humidity operations based on upcoming humidity events, predicted humidity levels, or both. The upcoming humidity events can include events that are predicted to increase or decrease the humidity. For example, the thermostat system 102 can determine that the humidity is likely going to decrease in response to the heater turning on in the morning. If the current humidity level does not satisfy, e.g., is lower than, the target humidity, the thermostat system 102 can delay increasing the humidity until a set amount of time after the heater turns on.

In some embodiments, the thermostat system 102 can proactively perform humidity operations based on upcoming humidity events. For example, the thermostat system 102 can proactively turn on a dehumidifier when the user schedule indicates that humidity levels are likely going to increase, even if the current humidity level is acceptable. In some examples, the thermostat system 102 can identify user activities which require dehumidification, e.g., cooking, showering, or working out. In some examples, the thermostat system 102 can predict an increase in humidity around the vents 124*a-d* when air is super cooled by an air conditioner. The thermostat system 102 can lower the humidity level of the property before a cooling cycle in response to predicting that condensation output by an air conditioner will increase the humidity.

In some embodiments, the thermostat system 102 can open the air intake 126 to cycle fresh air into the house and to lower the humidity levels in the property 112. In some embodiments, the thermostat system 102 can schedule a fresh air exchange, or another type of humidity controlling process, using the outdoor humidity, the outdoor temperature, and weather forecasts. The weather forecasts can be used to determine when to open the air intake 126 so that the fresh air exchange has a minimal impact on the indoor humidity. In some embodiments, the thermostat system 102 can adjust the indoor humidity before a fresh air exchange to offset an expected impact.

In some embodiments, the property 112 can be divided into two or more climate zones. For example, the two or more climate zones can include rooms, floors, or groups of rooms of the property 112. In some embodiments, the humidity level can be better optimized using sensors 114*a-d*. The sensors can detect changes in the humidity level throughout the property from zone to zone. For example, the humidity might be at different levels in the corners of the property and at a central location. In some embodiments, the thermostat system 102 can average the humidity readings from across the property and drive the thermostat humidity control based on the average humidity throughout the home, giving more accurate real time humidity control. In some embodiments, at least one sensor can be located in each climate zone.

The thermostat system 102 can control the temperature and humidity of each climate zone independently. In some embodiments, the thermostat system 102 can determine a portion of the property to which a target indoor humidity applies. The thermostat system 102 can control the HVAC system 120 to cause the indoor humidity at the portion of the property to move toward the target indoor humidity. In some embodiments, a common target humidity can be set for all of the zones. The thermostat system 102 can control the vents 124*a-d* with dampers and flaps to route air to individual climate zones in response to determining the humidity in the zone needs to be adjusted. In some embodiments, the thermostat system 102 can control humidity equipment in the climate zones to adjust the humidity levels. In some embodiments, the property 112 can include multiple HVAC systems connected to different climate zones.

In some embodiments, the thermostat system 102 can predict humidity levels for each climate zone. For example, the thermostat system can predict that a bathroom will have a high humidity level after a user takes a shower. The thermostat system can predict that a shower will be used based on the user schedule, or determine that a shower is in use based on water usage. The thermostat system can direct air with a low humidity to the climate zone in the bathroom in response to predicting the shower.

The thermostat system 102 is an example of a system implemented as computer programs on one or more computers in one or more locations, in which the systems, components, and techniques described in this specification are implemented. The thermostat 116 may include personal computers, mobile communication devices, and other devices that can send and receive data over the network 140. The network 140, e.g., a local area network ("LAN"), wide area network ("WAN"), the Internet, or a combination thereof, can connect the thermostat system 102, the sensors 114*a-d*, the thermostat 116, HVAC system 120, and the weather data servers. The thermostat system 102 may use a single server computer or multiple server computers operating in conjunction with one another, including, for example, a set of remote computers deployed as a cloud computing service.

The thermostat system 102 can include several different functional components, including the humidity analysis engine 104. The humidity analysis engine 104 can include one or more data processing apparatuses, can be implemented in code, or a combination of both. For instance, the humidity analysis engine 104 can include one or more data processors and instructions that cause the one or more data processors to perform the operations discussed herein.

The various functional components of the thermostat system 102 may be installed on one or more computers as separate functional components or as different modules of a same functional component. For example, the humidity analysis engine 104 of the thermostat system 102 can be implemented as computer programs installed on one or more computers in one or more locations that are coupled to each through a network. In cloud-based systems for example, these components can be implemented by individual computing nodes of a distributed computing system.

Figure 2:
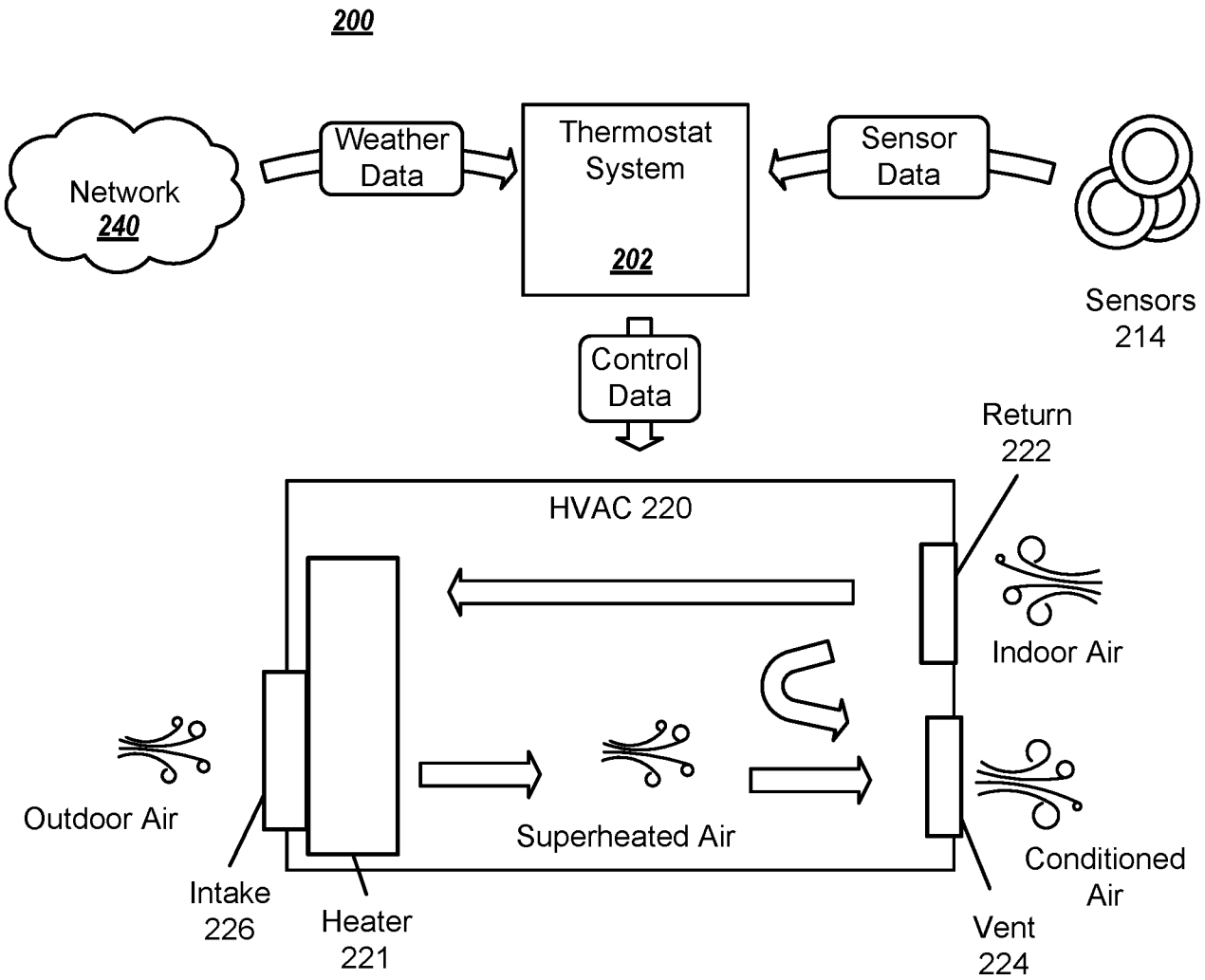
FIG. 2 depicts an example environment in which a thermostat system transmits control data to an HVAC.

FIG. 2 depicts an example environment 200 in which a thermostat system 202 transmits control data to an HVAC 220. For example, the thermostat system 202 can control HVAC 220 over network 240. In some embodiments, the sensors 214 can be included in the same hardware as the thermostat system 202.

In some embodiments, the thermostat system 202 can be the same as thermostat system 102, the HVAC 220 can be the same as HVAC system 120, the network 240 can be the same as network 140, and the sensors 214 can include sensors 114*a-d* of FIG. 1. During different seasons, humidity levels can change based on what is happening indoors. Based on indoor activities, the property may need to be humidified or dehumidified.

In some embodiments, the thermostat system 202 can control HVAC 220 to reduce the humidity using the dew point of outside air to satisfy a recommended humidity levels. In some embodiments, the thermostat system 202 can determine to reduce the humidity if a reading of the indoor humidity is higher than a recommended level. The thermostat system 202 can dehumidify the property using intake 226, e.g., an external air vent, without requiring a dehumidifier. In some embodiments, the intake 226 can be included in an external air ventilation system. The external air ventilation system may be attached to the HVAC 220, and can circulate outdoor air into the home.

The thermostat system 202 can use the intake 226 to dehumidify the air within the home using the principle of dew point. The relative humidity of air is dependent on the temperature of the air. Warmer air can hold more liquid than cooler air, so air at 40 F and 50% relative humidity has significantly less liquid than does air at 90 F and 50% relative humidity. The thermostat system 202 can dehumidify the property using the intake 226 when the indoor environment is heated to temperatures much warmer than the outdoor air, e.g., during the winter.

HVAC 220 can pull cool outdoor air into the home and naturally reduce the relative humidity of the air within the property by heating the air. The thermostat system 202 can turn on the intake 226 and heater 221 to bring down the humidity if the thermostat system 202 detects that the relative humidity level in the property is higher than the target value. For example, the thermostat system 202 can detect the humidity level in the property using sensors 214. In some embodiments, the outdoor air can be combined with indoor air from return 222 before being heated by heater 221. In some embodiments, air superheated by the heater 221 can be combined with indoor air from return 222 before being distributed throughout the property. The dehumidified air can be distributed throughout the property using vent 224. The thermostat system 202 can turn off the vent once the desired humidity level is reached.

Figure 3:
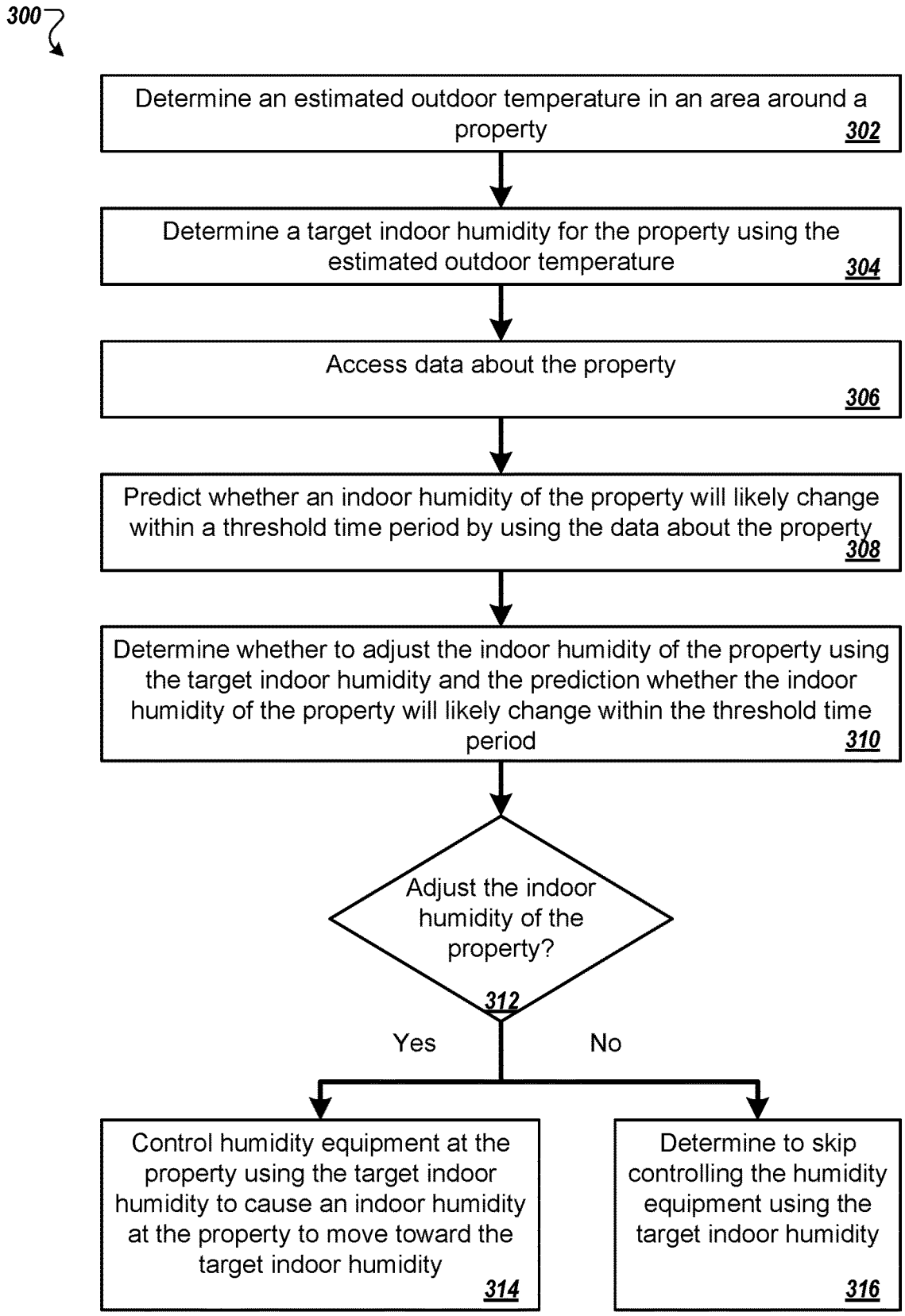
FIG. 3 is a flow diagram of a process for controlling humidity.

FIG. 3 is a flow diagram of a process 300 for controlling humidity. For example, the process 300 can be used by the thermostat system 102 from the environment 100.

A thermostat system determines an estimated outdoor temperature in an area around a property (302). In some embodiments, estimated outdoor temperature can be received from a server based on a location of the property. For example, the thermostat system can fetch the estimated outdoor temperature from a weather service system.

The thermostat system determines a target indoor humidity for the property using the estimated outdoor temperature (304). For example, the target indoor humidity can be determined using Equation (1) above. In some embodiments, the target indoor humidity can be based on the occupancy of the property. For example, if the property is currently occupied, the target indoor humidity can be set to a comfortable level, e.g., 50% relative humidity. If the property is not currently occupied, the target indoor humidity can be set to a lower level to prevent the formation of dew.

The thermostat system accesses data about the property (306). In some embodiments, at least some of the data can be received from one or more sensors at the property. For example, video analytics can be used to determine a number of occupants and user activities, e.g., cooking. In some examples, the data can include water usage. In some embodiments, the data can include humidity readings from humidity sensors.

The thermostat system predicts whether an indoor humidity of the property will likely change within a threshold time period by using the data about the property (308). In some embodiments, the prediction can be based on a number of occupants and user activities. For example, the thermostat system can predict that an indoor humidity of the property will likely increase in response to a determination that a user is cooking.

The thermostat system determines whether to adjust the indoor humidity of the property using the target indoor humidity and the prediction whether the indoor humidity of the property will likely change within the threshold time period (310). For example, the thermostat system can determine not to adjust the indoor humidity when the current indoor humidity is below the target humidity, but the thermostat system predicts the indoor humidity will likely increase, e.g., a user is currently cooking. In some examples, the thermostat system can determine to lower the indoor humidity when the current indoor humidity is significantly similar to the target humidity, but the thermostat system predicts the indoor humidity will likely increase, e.g., a user is currently cooking.

In some implementations, the thermostat system can determine whether to adjust the indoor humidity using data that indicates humidity equipment, types of humidity equipment, or both, available to adjust the indoor humidity at the property. The thermostat system can determine what humidity equipment, types of humidity equipment, or both, are available to adjust the indoor humidity using the estimated outdoor temperature, the estimated outdoor humidity, or both. In some examples, the thermostat system can determine what humidity equipment, types of humidity equipment, or both, are available to adjust the indoor humidity using data that indicates humidity equipment, or types of humidity equipment, that is installed at the property.

The analysis system determines whether or not to adjust the indoor humidity of the property (312). If analysis system determines to adjust the indoor humidity, the process 300 can follow the yes branch to step 314. If analysis system determines not to adjust the indoor humidity, the process 300 can follow the no branch to step 316.

In some embodiments, thermostat system determines whether a change between the estimated outdoor temperature and a prior estimated outdoor temperature satisfies a threshold. The prior estimated outdoor temperature can be a prior temperature estimated for a certain time of day, day of week, or a combination of these. The thermostat system can determine whether or not to adjust the indoor humidity of the property based on whether the change satisfies the threshold. For example, the thermostat system can determine not to adjust the indoor humidity in response to determining the change is greater than the threshold, e.g., the thermostat system can ignore rapid changes in temperature as noise. In some examples, the thermostat system can determine to adjust the indoor humidity in response to determining the change in greater than the threshold. In this example, the thermostat system can adjust the humidity in response to significant changes in temperature and ignore minor changes in temperature.

In response to determining to adjust the indoor humidity, the thermostat system controls humidity equipment at the property using the target indoor humidity to cause an indoor humidity at the property to move toward the target indoor humidity (314). For example, the thermostat system can cause an indoor humidity at the property to increase when a threshold is satisfied.

In response to determining not to adjust the indoor humidity, the thermostat system determines to skip controlling the humidity equipment using the target indoor humidity (316). For example, the thermostat system can determine to skip controlling the humidity, even if a current indoor humidity does not match the target indoor humidity.

The order of steps in the process 300 described above is illustrative only, and the process for controlling humidity can be performed in different orders. For example, the steps 306 and 308 can be performed before steps 302 and 304.

In some implementations, the process 300 can include additional steps, fewer steps, or some of the steps can be divided into multiple steps. For example, the process 300 can include steps 302-314. In some examples, the process 300 can include steps 302-312, and 316.

In some implementations, the thermostat system can determine when an indoor humidity adjustment should be made. The thermostat system can make this determining using data for a cooling cycle or a heating cycle for HVAC equipment at the property. For instance, the thermostat system can use a start time for the cycle, a duration for the cycle, a set point for the cycle, or a combination of these, to determine a time period during which humidity equipment should adjust the indoor humidity. This can reduce resource usage by reducing an amount of time HVAC equipment runs, improve an accuracy of adjusting humidity at the property, e.g., accounting for indoor humidity changes caused by the HVAC equipment, or a combination of both.

In some examples, homeowners with HVAC equipment including a whole home humidifier may keep the humidity levels in the home at a comfortable level during the winter months. A home can begin to feel extra dry when the heat starts running. Homeowners can run a humidifier during the winter to keep skin from becoming irritated. Homeowners may set the relative humidity at 50% because a family may feel most comfortable when the relative humidity level is kept around that level, and leave the relative humidity setting at the comfortable level throughout the year. However, the homeowners may not know that the indoor humidity should be adjusted lower as the outdoor temperature decreases to prevent mold and mildew growth within the home structure. It can be burdensome to continually check the outdoor temperature and adjust the humidity settings, so homeowners may forget to adjust the humidity setpoint. The thermostat system can automatically adjust the humidity setpoint to industry recommended levels during the winter to help both keep families comfortable and safe from mold and mildew growth in the structure of the home. The thermostat system can automatically adjust the humidity entirely wirelessly, without the need to install any new equipment in the home. The homeowner can control the thermostat system through a single device.

In some examples, a HVAC provider may tailor a customer's HVAC installation to best suit their family. The provider may strive to keep the air in the customer's home both safe and comfortable for them. Because of this focus on safety and comfort, the provider may install humidifiers for the customers because a properly humidified home is important for health and comfort. In some instances, the provider may install a separate humidistat for the customers. The provider may educate the customers to reduce the setpoint of their humidistat in the winter because it's important to reduce the humidity levels in the home during the winter to protect against mold growth near windows from too high humidity levels. However, the thermostat system can control the humidifier in a single unit, providing ease of use for the customer. The thermostat system can automatically change the humidity setpoint during the winter months for them to keep the humidity in the home at the industry suggested levels. Installation and an initial setup of a smart humidity rule is all that is needed to keep customers safe and comfortable with humidity. In some embodiments, the smart humidity rule can allow the desired humidity to be set at a percentage level which the thermostat will use for most of the year. Once the outdoor temperature drops lower in the winter months, the thermostat system can automatically set the humidity setpoint down to the industry suggested level for the colder months to help keep the home safe from mold. Outdoor temperature sensors do not need to be wired back to an expensive dedicated humidistat for this automation. A single device is all that is needed for automatically adjusting humidity.

In some examples, peripheral sections of a property can have a higher humidity than the average humidity for the property. A property owner may keep tabs on the humidity levels in their home and use a smart thermostat for smart humidity control to automatically adjust the humidity setpoint in the winter based on the outdoor temperature. However, a humidifier can turn on even if the windows start to fog up and dew starts to form, indicating that the humidity level is still too high in the house. The humidity level in a home can be quite different depending on the room, and the humidity in the area around the thermostat can be consistently much lower than in other rooms. Dew can still form in some areas even if the smart winter humidity control on the thermostat is enabled, and the humidifier setpoint has dropped appropriately using the automation system, in an effort to keep dew from forming around windows in the winter. Remote humidity/temperature sensors can be installed in each room, and the humidity setpoint rule can be set to take into account the humidity from all over the home, rather than just in one room. The humidifier can be prevented from turning on too early so that windows no longer fog up. The property owner can easily ensure that the humidity levels are actually being controlled appropriately to prevent mold.

In some examples, homeowners may perform actions which increase the humidity levels in the home. For example, during a period of time, multiple family members may take showers or boil water while cooking. During the winter, this can cause dew to form and windows can fog up. An external ventilation system can be used with the HVAC system to periodically pull in outdoor air to add fresh air to the home. The thermostat system can lower humidity levels in the winter when they get too high using the ventilation system. The smart winter humidity automation feature can adjust the humidifier setpoint appropriately during the winter. The humidity levels can be lowered when they increase higher than the recommended range. The humidity levels can be lowered without using a dehumidifier. The thermostat system can open the vent to pull in outdoor air when the humidity levels get too high. The relative humidity of the cool winter air outdoors can be much lower than the air in the home. When the external vent is opened, the relative humidity levels in the home can be quickly reduced to the recommended level. The homeowner can control the humidity in their home quite precisely in the winter using no extra equipment other than the smart thermostat and the existing equipment on the HVAC system.

For situations in which the systems discussed here collect personal information about users, e.g., addresses, user schedules, or video analysis, or may make use of personal information, the users may be provided with an opportunity to control whether programs or features collect personal information (e.g., information about a user's social actions or activities, profession, a user's preferences, or a user's current location), or to control whether and/or how to receive content from the content server that may be more relevant to the user. In addition, certain data may be anonymized in one or more ways before it is stored or used, so that personally identifiable information is removed. For example, a user's identity may be anonymized so that no personally identifiable information can be determined for the user, or a user's geographic location may be generalized where location information is obtained (such as to a city, ZIP code, or state level), so that a particular location of a user cannot be determined. Thus, the user may have control over how information is collected about him or her and used.

Figure 4:
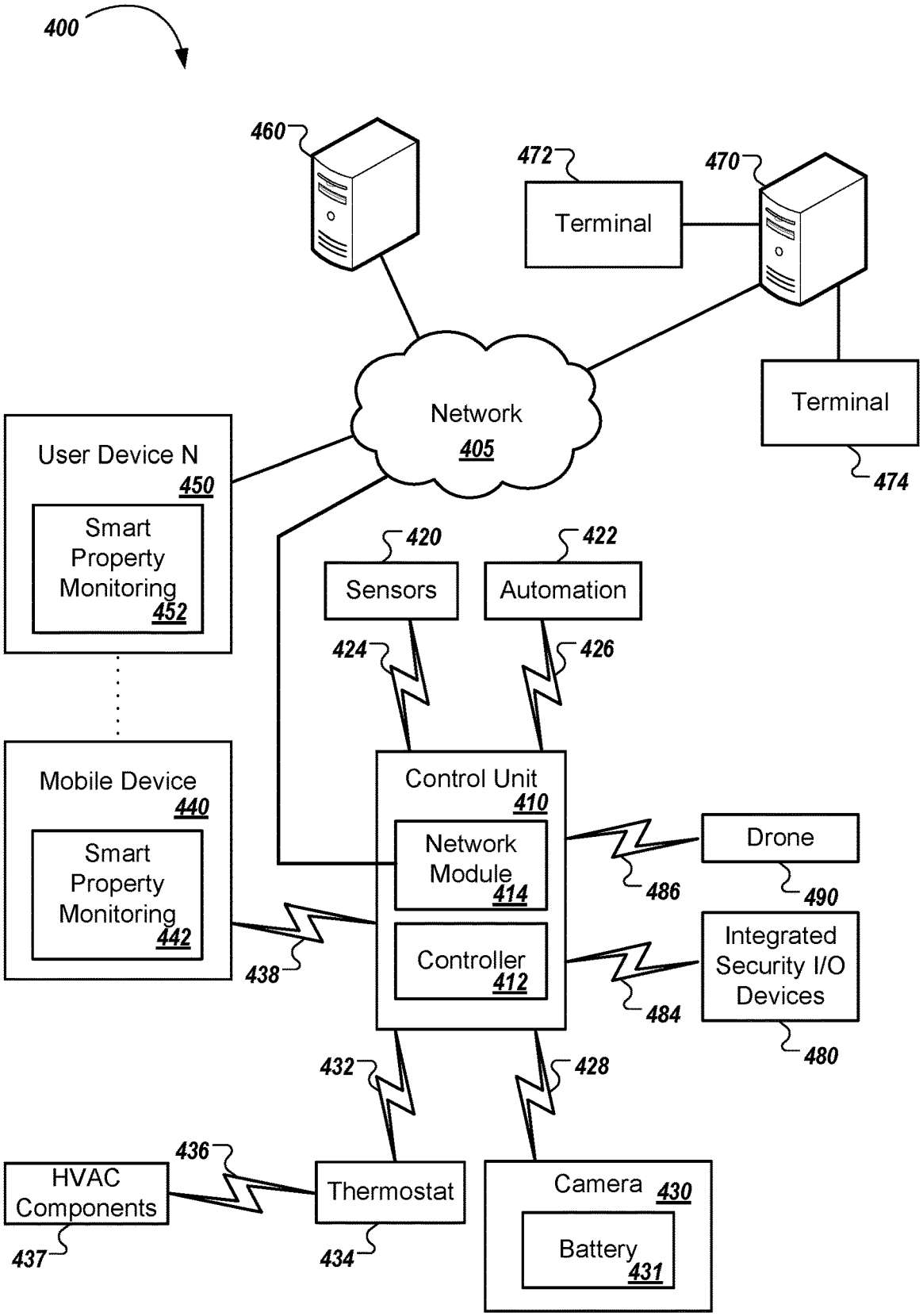
FIG. 4 is a diagram illustrating an example of a property monitoring system.

FIG. 4 is a diagram illustrating an example of a property monitoring system 400. The property monitoring system 400 includes a network 405, a control unit 410, one or more user devices 440 and 450, a monitoring application server 460, and a central alarm station server 470. In some examples, the network 405 facilitates communications between the control unit 410, the one or more user devices 440 and 450, the monitoring application server 460, and the central alarm station server 470.

The network 405 is configured to enable exchange of electronic communications between devices connected to the network 405. For example, the network 405 may be configured to enable exchange of electronic communications between the control unit 410, the one or more user devices 440 and 450, the monitoring application server 460, and the central alarm station server 470. The network 405 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 405 may include multiple networks or subnetworks, each of which may include, for example, a wired or wireless data pathway. The network 405 may include a circuit-switched network, a packet-switched data network, or any other network able to carry electronic communications (e.g., data or voice communications). For example, the network 405 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 405 may include one or more networks that include wireless data channels and wireless voice channels. The network 405 may be a wireless network, a broadband network, or a combination of networks including a wireless network and a broadband network.

The control unit 410 includes a controller 412 and a network module 414. The controller 412 is configured to control a control unit monitoring system (e.g., a control unit system) that includes the control unit 410. In some examples, the controller 412 may include a processor or other control circuitry configured to execute instructions of a program that controls operation of a control unit system. In these examples, the controller 412 may be configured to receive input from sensors, flow meters, or other devices included in the control unit system and control operations of devices included in the household (e.g., speakers, lights, doors, etc.). For example, the controller 412 may be configured to control operation of the network module 414 included in the control unit 410.

The network module 414 is a communication device configured to exchange communications over the network 405. The network module 414 may be a wireless communication module configured to exchange wireless communications over the network 405. For example, the network module 414 may be a wireless communication device configured to exchange communications over a wireless data channel and a wireless voice channel. In this example, the network module 414 may transmit alarm data over a wireless data channel and establish a two-way voice communication session over a wireless voice channel. The wireless communication device may include one or more of a LTE module, a GSM module, a radio modem, a cellular transmission module, or any type of module configured to exchange communications in one of the following formats: LTE, GSM or GPRS, CDMA, EDGE or EGPRS, EV-DO or EVDO, UMTS, or IP.

The network module 414 also may be a wired communication module configured to exchange communications over the network 405 using a wired connection. For instance, the network module 414 may be a modem, a network interface card, or another type of network interface device. The network module 414 may be an Ethernet network card configured to enable the control unit 410 to communicate over a local area network and/or the Internet. The network module 414 also may be a voice band modem configured to enable the alarm panel to communicate over the telephone lines of Plain Old Telephone Systems (POTS).

The control unit system that includes the control unit 410 includes one or more sensors. For example, the monitoring system 400 may include multiple sensors 420. The sensors 420 may include a lock sensor, a contact sensor, a motion sensor, or any other type of sensor included in a control unit system. The sensors 420 also may include an environmental sensor, such as a temperature sensor, a water sensor, a rain sensor, a wind sensor, a light sensor, a smoke detector, a carbon monoxide detector, an air quality sensor, etc. The sensors 420 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health monitoring sensor can be a wearable sensor that attaches to a user in the property. The health monitoring sensor can collect various health data, including pulse, heart-rate, respiration rate, sugar or glucose level, bodily temperature, or motion data. The sensors 420 can include a radio-frequency identification (RFID) sensor that identifies a particular article that includes a pre-assigned RFID tag.

The control unit 410 communicates with the module 422 and a camera 430 to perform monitoring. The module 422 is connected to one or more devices that enable property automation, e.g., home or business automation. For instance, the module 422 may be connected to one or more lighting systems and may be configured to control operation of the one or more lighting systems. Also, the module 422 may be connected to one or more electronic locks at the property and may be configured to control operation of the one or more electronic locks (e.g., control Z-Wave locks using wireless communications in the Z-Wave protocol). Further, the module 422 may be connected to one or more appliances at the property and may be configured to control operation of the one or more appliances. The module 422 may include multiple modules that are each specific to the type of device being controlled in an automated manner. The module 422 may control the one or more devices based on commands received from the control unit 410. For instance, the module 422 may cause a lighting system to illuminate an area to provide a better image of the area when captured by a camera 430. The camera 430 can include one or more batteries 431 that require charging.

A drone 490 can be used to survey the electronic system 400. In particular, the drone 490 can capture images of each item found in the electronic system 400 and provide images to the control unit 410 for further processing. Alternatively, the drone 490 can process the images to determine an identification of the items found in the electronic system 400.

The camera 430 may be a video/photographic camera or other type of optical sensing device configured to capture images. For instance, the camera 430 may be configured to capture images of an area within a property monitored by the control unit 410. The camera 430 may be configured to capture single, static images of the area or video images of the area in which multiple images of the area are captured at a relatively high frequency (e.g., thirty images per second)

or both. The camera 430 may be controlled based on commands received from the control unit 410.

The camera 430 may be triggered by several different types of techniques. For instance, a Passive Infra-Red (PIR) motion sensor may be built into the camera 430 and used to trigger the camera 430 to capture one or more images when motion is detected. The camera 430 also may include a microwave motion sensor built into the camera and used to trigger the camera 430 to capture one or more images when motion is detected. The camera 430 may have a "normally open" or "normally closed" digital input that can trigger capture of one or more images when external sensors (e.g., the sensors 420, PIR, door/window, etc.) detect motion or other events. In some implementations, the camera 430 receives a command to capture an image when external devices detect motion or another potential alarm event. The camera 430 may receive the command from the controller 412 or directly from one of the sensors 420.

In some examples, the camera 430 triggers integrated or external illuminators (e.g., Infra-Red, Z-wave controlled "white" lights, lights controlled by the module 422, etc.) to improve image quality when the scene is dark. An integrated or separate light sensor may be used to determine if illumination is desired and may result in increased image quality.

The camera 430 may be programmed with any combination of time/day schedules, system "arming state", or other variables to determine whether images should be captured or not when triggers occur. The camera 430 may enter a low-power mode when not capturing images. In this case, the camera 430 may wake periodically to check for inbound messages from the controller 412. The camera 430 may be powered by internal, replaceable batteries, e.g., if located remotely from the control unit 410. The camera 430 may employ a small solar cell to recharge the battery when light is available. The camera 430 may be powered by the controller's 412 power supply if the camera 430 is co-located with the controller 412.

In some implementations, the camera 430 communicates directly with the monitoring application server 460 over the Internet. In these implementations, image data captured by the camera 430 does not pass through the control unit 410 and the camera 430 receives commands related to operation from the monitoring application server 460.

The system 400 also includes thermostat 434 to perform dynamic environmental control at the property. The thermostat 434 is configured to monitor temperature and/or energy consumption of an HVAC system associated with the thermostat 434, and is further configured to provide control of environmental (e.g., temperature) settings. In some implementations, the thermostat 434 can additionally or alternatively receive data relating to activity at a property and/or environmental data at a property, e.g., at various locations indoors and outdoors at the property. The thermostat 434 can directly measure energy consumption of the HVAC system associated with the thermostat, or can estimate energy consumption of the HVAC system associated with the thermostat 434, for example, based on detected usage of one or more components of the HVAC system associated with the thermostat 434. The thermostat 434 can communicate temperature and/or energy monitoring information to or from the control unit 410 and can control the environmental (e.g., temperature) settings based on commands received from the control unit 410.

In some implementations, the thermostat 434 is a dynamically programmable thermostat and can be integrated with the control unit 410. For example, the dynamically programmable thermostat 434 can include the control unit 410, e.g., as an internal component to the dynamically programmable thermostat 434. In addition, the control unit 410 can be a gateway device that communicates with the dynamically programmable thermostat 434. In some implementations, the thermostat 434 is controlled via one or more module 422.

A module 437 is connected to one or more components of an HVAC system associated with a property, and is configured to control operation of the one or more components of the HVAC system. In some implementations, the module 437 is also configured to monitor energy consumption of the HVAC system components, for example, by directly measuring the energy consumption of the HVAC system components or by estimating the energy usage of the one or more HVAC system components based on detecting usage of components of the HVAC system. The module 437 can communicate energy monitoring information and the state of the HVAC system components to the thermostat 434 and can control the one or more components of the HVAC system based on commands received from the thermostat 434.

In some examples, the system 400 further includes one or more robotic devices 490. The robotic devices 490 may be any type of robots that are capable of moving and taking actions that assist in security monitoring. For example, the robotic devices 490 may include drones that are capable of moving throughout a property based on automated control technology and/or user input control provided by a user. In this example, the drones may be able to fly, roll, walk, or otherwise move about the property. The drones may include helicopter type devices (e.g., quad copters), rolling helicopter type devices (e.g., roller copter devices that can fly and also roll along the ground, walls, or ceiling) and land vehicle type devices (e.g., automated cars that drive around a property). In some cases, the robotic devices 490 may be robotic devices 490 that are intended for other purposes and merely associated with the system 400 for use in appropriate circumstances. For instance, a robotic vacuum cleaner device may be associated with the monitoring system 400 as one of the robotic devices 490 and may be controlled to take action responsive to monitoring system events.

In some examples, the robotic devices 490 automatically navigate within a property. In these examples, the robotic devices 490 include sensors and control processors that guide movement of the robotic devices 490 within the property. For instance, the robotic devices 490 may navigate within the property using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 490 may include control processors that process output from the various sensors and control the robotic devices 490 to move along a path that reaches the desired destination and avoids obstacles. In this regard, the control processors detect walls or other obstacles in the property and guide movement of the robotic devices 490 in a manner that avoids the walls and other obstacles.

In addition, the robotic devices 490 may store data that describes attributes of the property. For instance, the robotic devices 490 may store a floorplan and/or a three-dimensional model of the property that enables the robotic devices 490 to navigate the property. During initial configuration, the robotic devices 490 may receive the data describing attributes of the property, determine a frame of reference to the data (e.g., a property or reference location in the property), and navigate the property based on the frame of reference and the data describing attributes of the property.

Further, initial configuration of the robotic devices 490 also may include learning of one or more navigation patterns in which a user provides input to control the robotic devices 490 to perform a specific navigation action (e.g., fly to an upstairs bedroom and spin around while capturing video and then return to a property charging base). In this regard, the robotic devices 490 may learn and store the navigation patterns such that the robotic devices 490 may automatically repeat the specific navigation actions upon a later request.

In some examples, the robotic devices 490 may include data capture and recording devices. In these examples, the robotic devices 490 may include one or more cameras, one or more motion sensors, one or more microphones, one or more biometric data collection tools, one or more temperature sensors, one or more humidity sensors, one or more air flow sensors, and/or any other types of sensor that may be useful in capturing monitoring data related to the property and users in the property. The one or more biometric data collection tools may be configured to collect biometric samples of a person in the property with or without contact of the person. For instance, the biometric data collection tools may include a fingerprint scanner, a hair sample collection tool, a skin cell collection tool, and/or any other tool that allows the robotic devices 490 to take and store a biometric sample that can be used to identify the person (e.g., a biometric sample with DNA that can be used for DNA testing).

In some implementations, the robotic devices 490 may include output devices. In these implementations, the robotic devices 490 may include one or more displays, one or more speakers, and/or any type of output devices that allow the robotic devices 490 to communicate information to a nearby user.

The robotic devices 490 also may include a communication module that enables the robotic devices 490 to communicate with the control unit 410, each other, and/or other devices. The communication module may be a wireless communication module that allows the robotic devices 490 to communicate wirelessly. For instance, the communication module may be a Wi-Fi module that enables the robotic devices 490 to communicate over a local wireless network at the property. The communication module further may be a 900 MHz wireless communication module that enables the robotic devices 490 to communicate directly with the control unit 410. Other types of short-range wireless communication protocols, such as Bluetooth, Bluetooth LE, Z-wave, Zigbee, etc., may be used to allow the robotic devices 490 to communicate with other devices in the property. In some implementations, the robotic devices 490 may communicate with each other or with other devices of the system 400 through the network 405.

The robotic devices 490 further may include processor and storage capabilities. The robotic devices 490 may include any suitable processing devices that enable the robotic devices 490 to operate applications and perform the actions described throughout this disclosure. In addition, the robotic devices 490 may include solid-state electronic storage that enables the robotic devices 490 to store applications, configuration data, collected sensor data, and/or any other type of information available to the robotic devices 490.

The robotic devices 490 are associated with one or more charging stations. The charging stations may be located at a predefined home base or reference locations in the property. The robotic devices 490 may be configured to navigate to the charging stations after completion of tasks needed to be performed for the property monitoring system 400. For instance, after completion of a monitoring operation or upon instruction by the control unit 410, the robotic devices 490 may be configured to automatically fly to and land on one of the charging stations. In this regard, the robotic devices 490 may automatically maintain a fully charged battery in a state in which the robotic devices 490 are ready for use by the property monitoring system 400.

The charging stations may be contact based charging stations and/or wireless charging stations. For contact based charging stations, the robotic devices 490 may have readily accessible points of contact that the robotic devices 490 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 490 may charge through a wireless exchange of power. In these cases, the robotic devices 490 need only locate themselves closely enough to the wireless charging stations for the wireless exchange of power to occur. In this regard, the positioning needed to land at a predefined home base or reference location in the property may be less precise than with a contact based charging station. Based on the robotic devices 490 landing at a wireless charging station, the wireless charging station outputs a wireless signal that the robotic devices 490 receive and convert to a power signal that charges a battery maintained on the robotic devices 490.

In some implementations, each of the robotic devices 490 has a corresponding and assigned charging station such that the number of robotic devices 490 equals the number of charging stations. In these implementations, the robotic devices 490 always navigate to the specific charging station assigned to that robotic device. For instance, a first robotic device may always use a first charging station and a second robotic device may always use a second charging station.

In some examples, the robotic devices 490 may share charging stations. For instance, the robotic devices 490 may use one or more community charging stations that are capable of charging multiple robotic devices 490. The community charging station may be configured to charge multiple robotic devices 490 in parallel. The community charging station may be configured to charge multiple robotic devices 490 in serial such that the multiple robotic devices 490 take turns charging and, when fully charged, return to a predefined home base or reference location in the property that is not associated with a charger. The number of community charging stations may be less than the number of robotic devices 490.

Also, the charging stations may not be assigned to specific robotic devices 490 and may be capable of charging any of the robotic devices 490. In this regard, the robotic devices 490 may use any suitable, unoccupied charging station when not in use. For instance, when one of the robotic devices 490 has completed an operation or is in need of battery charge, the control unit 410 references a stored table of the occupancy status of each charging station and instructs the robotic device to navigate to the nearest charging station that is unoccupied.

The system 400 further includes one or more integrated security devices 480. The one or more integrated security devices may include any type of device used to provide alerts based on received sensor data. For instance, the one or more control units 410 may provide one or more alerts to the one or more integrated security input/output devices 480. Additionally, the one or more control units 410 may receive sensor data from the sensors 420 and determine whether to provide an alert to the one or more integrated security input/output devices 480.

The sensors 420, the module 422, the camera 430, the thermostat 434, and the integrated security devices 480 may communicate with the controller 412 over communication links 424, 426, 428, 432, 438, 484, and 486. The communication links 424, 426, 428, 432, 438, 484, and 486 may be a wired or wireless data pathway configured to transmit signals from the sensors 420, the module 422, the camera 430, the thermostat 434, the drone 490, and the integrated security devices 480 to the controller 412. The sensors 420, the module 422, the camera 430, the thermostat 434, the drone 490, and the integrated security devices 480 may continuously transmit sensed values to the controller 412, periodically transmit sensed values to the controller 412, or transmit sensed values to the controller 412 in response to a change in a sensed value. In some implementations, the drone 490 can communicate with the monitoring application server 460 over network 405. The drone 490 can connect and communicate with the monitoring application server 460 using a Wi-Fi or a cellular connection.

The communication links 424, 426, 428, 432, 438, 484, and 486 may include a local network. The sensors 420, the module 422, the camera 430, the thermostat 434, the drone 490 and the integrated security devices 480, and the controller 412 may exchange data and commands over the local network. The local network may include 802.11 "Wi-Fi" wireless Ethernet (e.g., using low-power Wi-Fi chipsets), Z-Wave, Zigbee, Bluetooth, "HomePlug" or other "Powerline" networks that operate over AC wiring, and a Category 5 (CAT5) or Category 6 (CAT6) wired Ethernet network. The local network may be a mesh network constructed based on the devices connected to the mesh network.

The monitoring application server 460 is an electronic device configured to provide monitoring services by exchanging electronic communications with the control unit 410, the one or more user devices 440 and 450, and the central alarm station server 470 over the network 405. For example, the monitoring application server 460 may be configured to monitor events (e.g., alarm events) generated by the control unit 410. In this example, the monitoring application server 460 may exchange electronic communications with the network module 414 included in the control unit 410 to receive information regarding events (e.g., alerts) detected by the control unit 410. The monitoring application server 460 also may receive information regarding events (e.g., alerts) from the one or more user devices 440 and 450.

In some examples, the monitoring application server 460 may route alert data received from the network module 414 or the one or more user devices 440 and 450 to the central alarm station server 470. For example, the monitoring application server 460 may transmit the alert data to the central alarm station server 470 over the network 405.

The monitoring application server 460 may store sensor and image data received from the monitoring system 400 and perform analysis of sensor and image data received from the monitoring system 400. Based on the analysis, the monitoring application server 460 may communicate with and control aspects of the control unit 410 or the one or more user devices 440 and 450.

The monitoring application server 460 may provide various monitoring services to the system 400. For example, the monitoring application server 460 may analyze the sensor, image, and other data to determine an activity pattern of a resident of the property monitored by the system 400. In some implementations, the monitoring application server 460 may analyze the data for alarm conditions or may determine and perform actions at the property by issuing commands to one or more of the controls 422, possibly through the control unit 410.

The central alarm station server 470 is an electronic device configured to provide alarm monitoring service by exchanging communications with the control unit 410, the one or more mobile devices 440 and 450, and the monitoring application server 460 over the network 405. For example, the central alarm station server 470 may be configured to monitor alerting events generated by the control unit 410. In this example, the central alarm station server 470 may exchange communications with the network module 414 included in the control unit 410 to receive information regarding alerting events detected by the control unit 410. The central alarm station server 470 also may receive information regarding alerting events from the one or more mobile devices 440 and 450 and/or the monitoring application server 460.

The central alarm station server 470 is connected to multiple terminals 472 and 474. The terminals 472 and 474 may be used by operators to process alerting events. For example, the central alarm station server 470 may route alerting data to the terminals 472 and 474 to enable an operator to process the alerting data. The terminals 472 and 474 may include general-purpose computers (e.g., desktop personal computers, workstations, or laptop computers) that are configured to receive alerting data from a server in the central alarm station server 470 and render a display of information based on the alerting data. For instance, the controller 412 may control the network module 414 to transmit, to the central alarm station server 470, alerting data indicating that a sensor 420 detected motion from a motion sensor via the sensors 420. The central alarm station server 470 may receive the alerting data and route the alerting data to the terminal 472 for processing by an operator associated with the terminal 472. The terminal 472 may render a display to the operator that includes information associated with the alerting event (e.g., the lock sensor data, the motion sensor data, the contact sensor data, etc.) and the operator may handle the alerting event based on the displayed information.

In some implementations, the terminals 472 and 474 may be mobile devices or devices designed for a specific function. Although FIG. 4 illustrates two terminals for brevity, actual implementations may include more (and, perhaps, many more) terminals.

The one or more user devices 440 and 450 are devices that host and display user interfaces. For instance, the user device 440 is a mobile device that hosts or runs one or more native applications (e.g., the smart property application 442). The user device 440 may be a cellular phone or a non-cellular locally networked device with a display. The user device 440 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 440 may perform functions unrelated to the monitoring system, such as placing personal telephone calls, playing music, playing video, displaying pictures, browsing the Internet, maintaining an electronic calendar, etc.

The user device 440 includes a smart property application 442. The smart property application 442 refers to a software/firmware program running on the corresponding mobile device that enables the user interface and features described throughout. The user device 440 may load or install the smart property application 442 based on data received over a network or data received from local media. The smart property application 442 runs on mobile devices platforms, such as iPhone, iPod touch, Blackberry, Google Android, Windows Mobile, etc. The smart property application 442 enables the user device 440 to receive and process image and sensor data from the monitoring system.

The user device 450 may be a general-purpose computer (e.g., a desktop personal computer, a workstation, or a laptop computer) that is configured to communicate with the monitoring application server 460 and/or the control unit 410 over the network 405. The user device 450 may be configured to display a smart property user interface 452 that is generated by the user device 450 or generated by the monitoring application server 460. For example, the user device 450 may be configured to display a user interface (e.g., a web page) provided by the monitoring application server 460 that enables a user to perceive images captured by the camera 430 and/or reports related to the monitoring system. Although FIG. 4 illustrates two user devices for brevity, actual implementations may include more (and, perhaps, many more) or fewer user devices.

In some implementations, the one or more user devices 440 and 450 communicate with and receive monitoring system data from the control unit 410 using the communication link 438. For instance, the one or more user devices 440 and 450 may communicate with the control unit 410 using various local wireless protocols such as Wi-Fi, Bluetooth, Z-wave, Zigbee, HomePlug (Ethernet over power line), or wired protocols such as Ethernet and USB, to connect the one or more user devices 440 and 450 to local security and automation equipment. The one or more user devices 440 and 450 may connect locally to the monitoring system and its sensors and other devices. The local connection may improve the speed of status and control communications because communicating through the network 405 with a remote server (e.g., the monitoring application server 460) may be significantly slower.

Although the one or more user devices 440 and 450 are shown as communicating with the control unit 410, the one or more user devices 440 and 450 may communicate directly with the sensors and other devices controlled by the control unit 410. In some implementations, the one or more user devices 440 and 450 replace the control unit 410 and perform the functions of the control unit 410 for local monitoring and long range/offsite communication.

In other implementations, the one or more user devices 440 and 450 receive monitoring system data captured by the control unit 410 through the network 405. The one or more user devices 440, 450 may receive the data from the control unit 410 through the network 405 or the monitoring application server 460 may relay data received from the control unit 410 to the one or more user devices 440 and 450 through the network 405. In this regard, the monitoring application server 460 may facilitate communication between the one or more user devices 440 and 450 and the monitoring system.

In some implementations, the one or more user devices 440 and 450 may be configured to switch whether the one or more user devices 440 and 450 communicate with the control unit 410 directly (e.g., through link 438) or through the monitoring application server 460 (e.g., through network 405) based on a location of the one or more user devices 440 and 450. For instance, when the one or more user devices 440 and 450 are located close to the control unit 410 and in range to communicate directly with the control unit 410, the one or more user devices 440 and 450 use direct communication. When the one or more user devices 440 and 450 are located far from the control unit 410 and not in range to communicate directly with the control unit 410, the one or more user devices 440 and 450 use communication through the monitoring application server 460.

Although the one or more user devices 440 and 450 are shown as being connected to the network 405, in some implementations, the one or more user devices 440 and 450 are not connected to the network 405. In these implementations, the one or more user devices 440 and 450 communicate directly with one or more of the monitoring system components and no network (e.g., Internet) connection or reliance on remote servers is needed.

In some implementations, the one or more user devices 440 and 450 are used in conjunction with only local sensors and/or local devices in a house. In these implementations, the system 400 includes the one or more user devices 440 and 450, the sensors 420, the module 422, the camera 430, and the robotic devices, e.g., that can include the drone 490. The one or more user devices 440 and 450 receive data directly from the sensors 420, the module 422, the camera 430, and the robotic devices and sends data directly to the sensors 420, the module 422, the camera 430, and the robotic devices. The one or more user devices 440, 450 provide the appropriate interfaces/processing to provide visual surveillance and reporting.

In other implementations, the system 400 further includes network 405 and the sensors 420, the module 422, the camera 430, the thermostat 434, and the robotic devices are configured to communicate sensor and image data to the one or more user devices 440 and 450 over network 405 (e.g., the Internet, cellular network, etc.). In yet another implementation, the sensors 420, the module 422, the camera 430, the thermostat 434, and the robotic devices are intelligent enough to change the communication pathway from a direct local pathway when the one or more user devices 440 and 450 are in close physical proximity to the sensors 420, the module 422, the camera 430, the thermostat 434, and the robotic devices to a pathway over network 405 when the one or more user devices 440 and 450 are farther from the sensors 420, the module 422, the camera 430, the thermostat 434, and the robotic devices. In some examples, the system leverages GPS information from the one or more user devices 440 and 450 to determine whether the one or more user devices 440 and 450 are close enough to the sensors 420, the module 422, the camera 430, the thermostat 434, and the robotic devices to use the direct local pathway or whether the one or more user devices 440 and 450 are far enough from the sensors 420, the module 422, the camera 430, the thermostat 434, and the robotic devices that the pathway over network 405 is required. In other examples, the system leverages status communications (e.g., pinging) between the one or more user devices 440 and 450 and the sensors 420, the module 422, the camera 430, the thermostat 434, and the robotic devices to determine whether communication using the direct local pathway is possible. If communication using the direct local pathway is possible, the one or more user devices 440 and 450 communicate with the sensors 420, the module 422, the camera 430, the thermostat 434, and the robotic devices using the direct local pathway. If communication using the direct local pathway is not possible, the one or more user devices 440 and 450 communicate with the sensors 420, the module 422, the camera 430, the thermostat 434, and the robotic devices using the pathway over network 405.

In some implementations, the system 400 provides end users with access to images captured by the camera 430 to aid in decision-making. The system 400 may transmit the images captured by the camera 430 over a wireless WAN network to the user devices 440 and 450. Because transmission over a wireless WAN network may be relatively expensive, the system 400 can use several techniques to reduce costs while providing access to significant levels of useful visual information (e.g., compressing data, down-sampling data, sending data only over inexpensive LAN connections, or other techniques).

In some implementations, a state of the monitoring system 400 and other events sensed by the monitoring system 400 may be used to enable/disable video/image recording devices (e.g., the camera 430). In these implementations, the camera 430 may be set to capture images on a periodic basis when the alarm system is armed in an "away" state, but set not to capture images when the alarm system is armed in a "stay" state or disarmed. In addition, the camera 430 may be triggered to begin capturing images when the alarm system detects an event, such as an alarm event, a door-opening event for a door that leads to an area within a field of view of the camera 430, or motion in the area within the field of view of the camera 430. In other implementations, the camera 430 may capture images continuously, but the captured images may be stored or transmitted over a network when needed.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A system comprising one or more computers and one or more storage devices on which are stored instructions that are operable, when executed by the one or more computers, to cause the one or more computers to perform operations comprising:

determining an estimated outdoor temperature in an area around a property;

determining, using the estimated outdoor temperature, a target indoor humidity for the property;

accessing data about the property, at least some of the data received from one or more sensors at the property;

predicting, using the data about the property, whether an indoor humidity of the property will likely change within a threshold time period;

determining, using the target indoor humidity and the prediction whether the indoor humidity of the property will likely change within the threshold time period, whether to adjust the indoor humidity of the property; and in response to determining to adjust the indoor humidity of the property, controlling, using the target indoor humidity, humidity equipment at the property to cause an indoor humidity at the property to move toward the target indoor humidity.

2. The system of claim 1, wherein determining whether to adjust the indoor humidity of the property uses i) the target indoor humidity, ii) the prediction whether the indoor humidity of the property will likely change within the threshold time period, and iii) a humidity threshold.

3. The system of claim 2, wherein the humidity threshold comprises one or more of a maximum humidity level or a minimum humidity level.

4. The system of claim 1, wherein determining whether to adjust the indoor humidity of the property uses i) the target indoor humidity, ii) the prediction whether the indoor humidity of the property will likely change within the threshold time period, and iii) a humidity set point setting for a heating, ventilation, and air conditioning system.

5. The system of claim 1, wherein:

accessing data about the property comprising accessing sensor data that indicates one or more current activities at the property; and predicting whether the indoor humidity of the property will likely change within the threshold time period uses the sensor data that indicates the one or more current activities at the property.

6. The system of claim 1, wherein controlling the humidity equipment comprising controlling one or more of a thermostat, a humidifier, a dehumidifier, or an external air vent.

7. The system of claim 1, the operations comprising selecting, from multiple different types of humidity equipment, the humidity equipment using one or more of the estimated outdoor temperature, or an estimated outdoor humidity.

8. The system of claim 1, wherein controlling, using the target indoor humidity, humidity equipment at the property to cause an indoor humidity at the property to move toward the target indoor humidity comprises adjusting a setting on a thermostat to cause the indoor humidity at the property to move toward the target indoor humidity.

9. The system of claim 8, wherein adjusting the setting on the thermostat to cause the indoor humidity at the property to move toward the target indoor humidity is performed without receiving user input.

10. The system of claim 1, the operations comprising:

determining one or more attributes of a heating cycle or a cooling cycle at the property; and selecting, using the one or more attributes, a time period during which to control the humidity equipment, wherein controlling the humidity equipment comprises sending one or more instructions to the humidity equipment to cause the humidity equipment to adjust the indoor humidity during the time period.

11. The system of claim 10, wherein the one or more attributes of the heating cycle or the cooling cycle comprise one or more of a start time for the cycle, a duration for the cycle, or a set point for the cycle.

12. A computer-implemented method comprising:

determining, using an estimated outdoor temperature in an area around a property, a target indoor humidity for the property;

accessing humidity data that indicates a current indoor humidity at the property;

predicting, using data from one or more sensors at the property, whether the current indoor humidity of the property will likely change within a threshold time period;

determining, using the target indoor humidity and the prediction whether the current indoor humidity of the property will likely change within the threshold time period, whether to adjust the indoor humidity of the property; and in response to determining not to adjust the indoor humidity of the property, determining to skip controlling humidity equipment at the property to cause an indoor humidity at the property to move toward the target indoor humidity.

13. The method of claim 12, wherein determining whether to adjust the indoor humidity of the property uses i) the target indoor humidity, ii) the prediction whether the indoor humidity of the property will likely change within the threshold time period, and iii) a humidity threshold.

14. The method of claim 12, wherein determining whether to adjust the indoor humidity of the property uses i) the target indoor humidity, ii) the prediction whether the indoor humidity of the property will likely change within the threshold time period, and iii) a humidity set point setting for a heating, ventilation, and air conditioning system.

15. The method of claim 12, wherein:

accessing data about the property comprising accessing sensor data that indicates one or more current activities at the property; and predicting whether the indoor humidity of the property will likely change within the threshold time period uses the sensor data that indicates the one or more current activities at the property.

16. The method of claim 12, comprising determining, from multiple different types of humidity equipment, humidity equipment available to adjust the indoor humidity at the property, wherein determining whether to adjust the indoor humidity uses data identifying the humidity equipment available to adjust the indoor humidity at the property.

17. The method of claim 16, wherein determining the humidity equipment available to adjust the indoor humidity at the property uses one or more of the estimated outdoor temperature, or an estimated outdoor humidity.

18. The method of claim 12, comprising:

determining whether a change between the estimated outdoor temperature and a prior estimated outdoor temperature satisfies a threshold, wherein determining whether to adjust the indoor humidity of the property uses a result of determining that the change between the estimated outdoor temperature and the prior estimated temperature satisfies the threshold.

19. One or more non-transitory computer storage media encoded with instructions that, when executed by one or more computers, cause the one or more computers to perform operations comprising:

determining an estimated outdoor temperature in an area around a property;

determining, using the estimated outdoor temperature, a target indoor humidity for the property;

accessing data about the property, at least some of the data received from one or more sensors at the property;

predicting, using the data about the property, whether an indoor humidity of the property will likely change within a threshold time period;

determining, using the target indoor humidity and the prediction whether the indoor humidity of the property will likely change within the threshold time period, whether to adjust the indoor humidity of the property; and in response to determining not to adjust the indoor humidity of the property, determining to skip controlling humidity equipment at the property to cause an indoor humidity at the property to move toward the target indoor humidity.

20. The computer storage media of claim 19, wherein determining whether to adjust the indoor humidity of the property uses i) the target indoor humidity, ii) the prediction whether the indoor humidity of the property will likely change within the threshold time period, and iii) a humidity threshold.

* * * * *